US010852005B2

(12) United States Patent
Faraldi et al.

(10) Patent No.: US 10,852,005 B2
(45) Date of Patent: Dec. 1, 2020

(54) METHOD AND HOUSEHOLD APPLIANCE FOR CONTROLLING HUMIDITY

(71) Applicant: ELECTROLUX APPLIANCES AKTIEBOLAG, Stockholm (SE)

(72) Inventors: Paolo Faraldi, Forli (IT); Edoardo Betti, Forli (IT); Arianna Bozzato, Pordenone (IT); Evi Hessenauer, Rothenberg ob der Tauber (DE); Giovanni Di Piano, Forli (IT); Lorenzo Mucciarella, Forli (IT); Milka Bekjarova, Forli (IT); Lorenzo Gattei, Forli (IT); Nicola Guida, Forli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/769,099

(22) PCT Filed: Feb. 3, 2016

(86) PCT No.: PCT/EP2016/052240
§ 371 (c)(1),
(2) Date: Apr. 18, 2018

(87) PCT Pub. No.: WO2017/067671
PCT Pub. Date: Apr. 27, 2017

(65) Prior Publication Data

US 2018/0299138 A1 Oct. 18, 2018

(30) Foreign Application Priority Data

Oct. 22, 2015 (EP) ..... 15191080

(51) Int. Cl.
*F24C 15/20* (2006.01)
*F24C 15/32* (2006.01)
(Continued)

(52) U.S. Cl.
CPC ..... *F24C 15/2007* (2013.01); *F24C 7/085* (2013.01); *F24C 15/003* (2013.01);
(Continued)

(58) Field of Classification Search
CPC .... F24C 15/2007; F24C 7/085; F24C 15/003; F24C 15/2021; F24C 15/327; H05B 6/6458; H05B 6/6479
See application file for complete search history.

(56) References Cited

U.S. PATENT DOCUMENTS 9,518,745 B2 * 12/2016 Boubeddi ..... F24C 7/085
9,907,436 B2 * 3/2018 Reese ..... A47J 39/003
(Continued)

FOREIGN PATENT DOCUMENTS

CN 201775510 U 3/2011
DE 102005055773 A1 5/2007
(Continued)

OTHER PUBLICATIONS

Office action (with translation) issued in corresponding Chinese Patent Application No. 201680058407.7 dated Dec. 19, 2018, 24 pages.
(Continued)

*Primary Examiner* — David J Laux
(74) *Attorney, Agent, or Firm* — Pearne & Gordon LLP

(57) ABSTRACT

Household appliance (1) for cooking and/or baking food stuffs or bakery ware (2) comprising a heatable cavity (3) for placing the food stuffs or bakery ware (2), an access door (4) for accessing the cavity (3), a compartment (5) located exterior of said cavity (3), said compartment being in fluid communication with said cavity (3) by at least one duct (6), a control unit (10), at least one first sensor (8) located in the compartment (5) and being connected to the control unit (10), and wherein the at least one first sensor (8) is capable
(Continued)

of measuring a first input value in said compartment (5), and at least one second sensor (9) capable of measuring a second input value, wherein said second input value is a temperature value wherein said control unit comprises a matrix of humidity index values, said matrix being deposited in said control unit (10), and wherein said control unit (10) is capable of correlating said input value of said at least one first sensor (8) to a humidity index value from said matrix.

18 Claims, 5 Drawing Sheets

(51) Int. Cl.
*F24C 7/08* (2006.01)
*F24C 15/00* (2006.01)
*H05B 6/64* (2006.01)

(52) U.S. Cl.
CPC ..... *F24C 15/2021* (2013.01); *F24C 15/327* (2013.01); *H05B 6/6458* (2013.01); *H05B 6/6479* (2013.01)

(56) References Cited

U.S. PATENT DOCUMENTS

2010/0064902 A1* 3/2010 Sakane ..... F24C 15/2007 99/352
2012/0294992 A1* 11/2012 Sager ..... F24C 7/08 426/231
2017/0130968 A1* 5/2017 Nagraj ..... F24C 7/085

FOREIGN PATENT DOCUMENTS

EP 0000957 A1 3/1979
EP 0319673 A1 6/1989
EP 2390587 A2 11/2011

OTHER PUBLICATIONS

International Search Report and Written Opinion issued in corresponding application No. PCT/EP2016/052240 dated May 4, 2016, 13 pages.

* cited by examiner

METHOD AND HOUSEHOLD APPLIANCE FOR CONTROLLING HUMIDITY

The present invention relates to household appliance for cooking and/or baking foodstuffs or bakery ware and a method for controlling humidity in a cavity of a household appliance.

It is generally known that cooking and/or baking foodstuffs or bakery ware can be carried out according to different methods and under widely differing conditions. Household steam ovens exist, in which steam can be driven to increase humidity into the cooking cavity, for those cooking cycle where supply of additional humidity is required. Such so-called steaming process comprises introducing steam or water into the cooking cavity. Systems used to generate or introduce steam in or into the cooking cavity of cooking ovens are widely known For the generation of steam, such systems are usually based either on a boiler arrangement located outside the cooking cavity or on a heated pan filled by water inside the cavity. In such steaming ovens, there is a need for an appropriate control of the steam being let into or generated in the cooking cavity, in accordance with the actual cooking requirements.

However, also when foodstuffs are cooked in an oven without such steaming or without the operation of such steaming function, humidity, as well as temperature and time, play a key role in the final cooking results. Accordingly, the same problems apply when foodstuff and/or bakery goods release moisture into the cavity upon being heated without such steaming process.

On the other hand, many cooking processes require a dry environment, at least for a part of the cooking process. Especially in case of heavy food loads, the spontaneous generation of humidity due to food can create in the oven cavity a way too humid environment.

Many domestic ovens are therefore equipped by an exhaust system, to let fumes and humidity in excess to get out from the cavity.

However, the effectiveness of the humidity reduction in the cavity is limited. Therefore, particularly for meat roasting or grilling, it is sometimes suggested to keep the door slightly open during a cooking operation. Ovens that are more professional are often equipped with an active system to reduce humidity during cooking process, typically achieved by a dedicated duct and a fan that pushes air from outside environment into the cavity. These systems can be correlated with a humidity measurement device of some sort to control/trigger the humidity abatement process. Beside the cooking performance optimization aspects, if such control is not available, the corresponding usage of energy by such ovens for generating steam is quite high.

In a steam oven, the above-described control usually uses as an actuator a steam generator, and as a sensor a means to evaluate humidity actually present in the oven cavity. Direct measurements of the humidity level within the cooking cavity are known, based on specific sensors.

Particularly, while accurate and correct measurement are desired, such sensor placement within the cooking cavity is disadvantageous in involving measurement of humidity in a food cooking environment, particularly when exceeding 100° C. and/or a relative humidity of more than 100%.

The document EP 0 701 388, for example, describes such solution with a sensor capable of measuring the relative oxygen concentration within the cavity. Sensors in close contact with oven cavity environment, however, can be affected by pollution due to cooking fumes, splashes of grease and vapors. Accordingly, the known solutions are quite expensive, and, even if suitable for professional ovens, application in household appliances is disadvantageous and not suitable.

The document U.S. Pat. No. 5,517,980 discloses an indirect system to measure humidity, for example, based on pressure fields generated by the cooking fan on forced convection ovens. A small-bore by-pass tube between the inside of the cooking cavity and the outside of the cooking cavity is provided, including a temperature probe. Such tube usually is located in an area close to and in front of the axis of rotation of the fan wheel, where a negative pressure with respect to the ambient pressure is created due to the air suction action of the fan wheel. When a cooking process is being carried out for which steam is thought to be let into the cooking cavity (e.g., steaming or mixed steam and hot air operations), the steam itself condenses onto the food being cooked, so that it transfers heat to the food and causes it to cook. Meanwhile, air at a relatively low temperature flows in from the conduit which is communicating with the outside, thanks to the negative pressure effect above described. As the cooking process progresses, there is a gradual decrease in the demand of steam, when the food is eventually cooked or the amount of steam is enough to saturate the cavity. Therefore, excess steam creates a slight overpressure inside the cooking cavity and starts to flow out from the tube, where the probe can detect a temperature increase: such signal can be effectively correlated to humidity inside the cavity. However, such system is highly depending on fan efficiency and implementation. Particularly, the negative pressure effect is negligible, preventing a correct measurement hence humidity evaluation.

The documents US 2013/0308678 A1 and US 2001/0051202 A1, for example, describe systems for the sampling of oven air, using one or more sensors, wherein by constantly monitoring a desired and an actual value of the humidity and/or temperature in the oven in relation to the cooking or baking temperature and/or cooking or baking time are measured. Thereby, sensors may be placed in a compartment exterior to the cavity, e.g. an air-sampling channel, for directly measuring characteristics of the oven cavity's air. Such systems, however, disclose in general a process of controlling temperature and humidity in an oven during a cooking process and how to use the detected humidity values required by a closed loop control.

It is an object of the present invention to overcome the above-described constraints.

It is a further object of the present invention to provide a household appliance, particularly an oven, and a method for cooking and/or baking food stuffs or bakery ware for efficiently controlling humidity in a cavity of a household appliance in a more simple and inexpensive way, particularly applying relatively inexpensive means, such as an inexpensive humidity sensor.

It is a still further object of the present invention to provide a household appliance and a method for cooking and/or baking food stuffs or bakery ware for efficiently controlling humidity in a cavity of a household appliance, which allows determining the actual humidity within a cavity of the household appliance independent from measuring the actual humidity value in the cavity.

In the following description of the present invention, reference is made particularly to a household appliance, particularly an oven, for cooking and/or baking foodstuffs or bakery ware. Such household appliance, particularly an oven, according to the present invention may be particularly an oven that is adapted also to cook foods by steaming, particularly by introducing water or steam into the cooking cavity to create special food cooking conditions, without being bound thereto. It will be immediately understood by a person skilled in the art that what is described and claimed herein may alternatively be also applied to any other type of household appliances for cooking and/or baking foodstuffs or bakery ware, particularly to household appliances without such steaming and/or in a cooking process without such steaming process. This is, as foodstuffs and/or bakery ware to be cooked may release a certain volume of moisture and generate a certain degree of humidity within the cavity, particularly when heated. Therefore, it is to be understood that the household appliance, particularly an oven, according to the present invention preferably is a cooking oven with steaming function. Alternatively, and in a non-binding way, however, the present invention is also applicable to any other type of household appliances for cooking and/or baking foodstuffs or bakery ware without such steaming function and is considered herein to be within the scope of the present invention.

A household appliance, particularly an oven, for cooking and/or baking foodstuffs or bakery ware as disclosed herein comprises at least a heatable cavity for placing the foodstuffs or bakery ware, an access door for accessing the cavity, a compartment located exterior of said cavity, said compartment being in fluid communication with said cavity by at least one duct, a control unit, at least one first sensor located in said compartment and being connected to the control unit, w herein the at least one first sensor is capable of measuring a first input value in said compartment, and at least one second sensor capable of measuring a second input value, wherein said second input value is a temperature value.

In such household appliance, particularly an oven, according to the present invention said control unit comprises a matrix of humidity index values, said matrix is deposited in said control unit, and said control unit is capable of correlating said input value of said at least one first sensor to a humidity index value from said matrix.

It will be immediately understood by a person skilled in the art that such household appliance, particularly an oven, according to the present invention provides an advantageous approach to estimate the actual humidity within the cavity of the household appliance.

Particularly, such household appliance, particularly an oven, according to the present invention may use two layers of stored values: 1) the correlation of a measured value by the first, or the first and the second sensor, to a matrix of humidity values, particularly in the form of a lookup table, which along with the sensor measurements, allows the identification of a humidity index estimating an actual humidity level within the cavity at a defined time; and 2) a target value for humidity index, with whom the instantaneously evaluated value is compared, for the sake of a closed loop control to react.

The above-described problems are also advantageously solved by a method for controlling humidity in a cavity of a household appliance, particularly an oven, as disclosed herein, wherein the household appliance, particularly an oven, preferably is a household appliance, particularly an oven, according to the present invention.

The method according to the present invention comprises at least the following steps:

a step a) of adjusting a set humidity value for a boost cycle and/or a cooking cycle and/or a de-steaming cycle of a cooking process, preferably by a user input;

a step b) of humidity control, carried out during a cooking cycle and, optionally, a desteaming cycle, said step of humidity control comprising at least the following steps:

i) measuring an input value by the at least one first sensor and/or measuring an input value by the at least one second sensor;

ii) correlating said input value of said at least one first sensor and/or said at least one second sensor to a humidity index value from a matrix, wherein said matrix comprises such humidity index value, preferably said matrix being deposited in a control unit of the household appliance, said correlation comprising comparing said input value of said at least one first sensor and/or said at least one second sensor to the matrix;

iii) comparing said humidity index value from step ii) to a set humidity value for a boost cycle and/or a cooking cycle and/or a de-steaming cycle of a cooking process from step a); and iv) determining and/or generating an output signal for controlling a humidity controlling means, particularly a humidity generating means, preferably a steam generating means;

v) controlling said humidity controlling means and generating a humidity value in the cavity according to the output signal.

The above described problems are also advantageously solved by a use of a sensor, particularly a humidity sensor as described herein in connection with the various embodiments of the present invention, in a method for controlling humidity in a cavity of a household appliance, preferably according to the present invention and/or a use of a sensor, particularly a humidity sensor as described herein in connection with the various embodiments of the present invention in a household appliance, particularly an oven, according to the present invention.

It is to be understood that each and any embodiment and feature described herein in connection with a method according to the present invention or a use according to the present invention may also be a feature of an appliance according to the present invention. It is also to be understood that each and any embodiment and feature described herein in connection with an appliance according to the present invention may also be a feature of a method according to the present invention or a use according to the present invention.

The present inventors have surprisingly found that a relatively inexpensive first sensor capable of measuring a first input value, allows estimation and control of humidity in a cavity of a household appliance, particularly an oven, and/or method according to the present invention.

It is preferred according to the method and/or the household appliance, particularly an oven, according to the present invention that the at least one first sensor capable of measuring a first input value is a humidity sensor, wherein said first input value is a humidity value. Thereby, said humidity value, preferably is a value of relative humidity and said first sensor accordingly is a relative humidity sensor. Such relative humidity sensor may be of a type as usually applied in Heating, Ventilation and Air Conditioning (HVAC) or automotive applications. In an embodiment, a first sensor is a capacitive humidity sensor. Such humidity sensor is of particular advantage being relatively inexpensive and easily available.

However, alternatively, and without being bound thereto other types of sensor may be used, for example, a pressure sensor, whereby the first input value may accordingly be a pressure value.

It is to be understood that within the present description, the present invention is described particularly with regard to a humidity sensor being the first sensor. However, with only slight modification, alternatively a pressure sensor may be used as first sensor, which is thus considered to be within the scope of the invention without being bound thereto.

In a further advantageous embodiment of the method and/or the household appliance, particularly an oven, according to the present invention, according to which said at least one first sensor capable of measuring a first input value, said first input value is an input value within said compartment. Accordingly, where the first sensor is a humidity sensor, said first input value is a humidity value within said compartment, and preferably is a value of relative humidity, within said compartment.

Such first sensor, particularly in embodiments according to which the first sensor is a humidity sensor, is arranged in said compartment located exterior of the cavity of the household appliance.

A second sensor according to the present invention is capable of measuring a second input value, wherein said second input value is a temperature value. According to an embodiment of the present invention, said second sensor is connected to the control unit. Accordingly, the control unit is capable of reading both the first input value of the first sensor and the input value of said second sensor. Preferably, the input value of the second sensor is a temperature value referring to the temperature in the cavity. Particularly, the second sensor may be arranged to measure the temperature in the cavity.

It is thereby preferred that said control unit is capable of correlating said input value of said at least one first sensor and of said at least one second sensor to a humidity index value from said matrix. This advantageously allows correlating said input value of said at least one first sensor and the input value of said at least one second sensor to a humidity index value from a matrix.

In a preferred embodiment of the household appliance, particularly an oven, for cooking and/or baking foodstuffs or bakery ware and/or a method according to the present invention, the at least one second sensor is located in the cavity of said household appliance.

In connection therewith, it will be understood that where a sensor is located in the cavity, the input value, preferably, is to be understood as the value of the respective measured parameter, i.e. humidity, relative humidity, temperature and/or pressure, in the cavity. Accordingly, where a sensor is located in the compartment, the input value is the value of the respective measured parameter, i.e. humidity, relative humidity, temperature and/or pressure, in the compartment.

It is considered herein, that such second sensor capable of measuring a second input value, wherein said second input value is a temperature value, is a temperature sensor, which preferably is selected from the group comprising thermistor and thermocouple.

In a preferred embodiment of the household appliance, particularly an oven, for cooking and/or baking foodstuffs or bakery ware and/or a method according to the present invention, the control unit is capable of correlating said input value of said at least one first sensor, or of said at least one first sensor and said at least one second sensor to a humidity index value, said correlation comprising comparing said input value of said at least one first sensor and/or said at least one second sensor to said matrix, and comparing said humidity index value to a set humidity value, and determining and/or generating an output signal for controlling a humidity controlling means, particularly a humidity generating means, preferably a steam generating means.

In a preferred embodiment of a method for controlling humidity in a cavity of a household appliance, preferably a household appliance, particularly an oven, according to the present invention, such method comprises at least the following steps:

a step a) of adjusting a set humidity value for a boost cycle and/or a cooking cycle and/or a de-steaming cycle of a cooking process, preferably by a user input;

a step b) of humidity control, carried out during a cooking cycle and, optionally, a desteaming cycle, said step of humidity control comprising at least the following steps:

i) measuring an input value by the at least one first sensor and measuring an input value by the at least one second sensor;

ii) correlating said input value of said at least one first sensor and of said at least one second sensor to a humidity index value from a matrix, wherein said matrix comprises such humidity index value, preferably said matrix being deposited in a control unit of the household appliance, said correlation comprising comparing said input value of said at least one first sensor and of said at least one second sensor to the matrix;

iii) comparing said humidity index value from step ii) to a set humidity value for a boost cycle and/or a cooking cycle and/or a de-steaming cycle of a cooking process from step a); and iv) determining and/or generating an output signal for controlling a humidity controlling means, particularly a humidity generating means, preferably a steam generating means;

v) controlling said humidity controlling means and generating a humidity value in the cavity according to the output signal.

In a further advantageous embodiment of the method and/or household appliance, particularly an oven, according to the present invention said compartment, preferably said at least one first sensor is located at a position exposed to temperatures of about 100° C. or less and/or exposed to relative humidity of about 100% or less during operation of said household appliance.

This advantageously allows measuring humidity and/or pressure, preferably humidity, within said compartment by said first sensor, preferably a humidity sensor. Also other parameters, for example, pressure or temperature may be measured by other sensors arranged in said compartment, particularly pressure and/or temperature sensors according to the present invention, without the risk of the sensor to be damaged, particularly by heat and/or higher relative humidity, more particularly saturation, i.e. 100% relative humidity.

Preferably, said compartment, more preferably said at least one first sensor, is located at a position exposed to temperatures of 100° C. or less and/or exposed to relative humidity of 100% or less during operation of said household appliance. Thereby it is also preferred that said at least one first sensor is located at a position in the compartment where air temperature is kept under control, and, preferably is below 100° C., more preferably below 90° C., particularly during a cooking operation and/or when measurement is to be performed. Additionally or alternatively, said at least one first sensor may be located at a position where dirt and soiling, particularly generated by cooking operations, are not significantly affecting the sensor.

Advantageously, the kind of sensor to be used as a first sensor according to the present invention may thus be relatively cheap and simple to operate, which particularly allows application on a mass production household appliance.

In a further advantageous embodiment of the method and/or the household appliance, particularly an oven, according to the present invention, said compartment is a cooling channel and/or a cooling chamber, preferably an oven cooling channel and/or wherein said compartment located exterior of said cavity, is located on top of said cavity.

This placement of the first sensor is of particular advantage, in that the compartment wherein said first sensor is placed, preferably a cooling channel and/or cooling chamber, represents a system always present in built-in household appliances, particularly household ovens, to control the temperature of technical internal volumes and of external surfaces.

A cavity of a household appliance, particularly an oven, according to the present invention preferably is also equipped with a fumes exhaust, to evacuate overpressure due to cooking process, e.g. due to air expansion and/or vapor. It will be understood that the stream of fumes is collected in the compartment, preferably a cooling air stream, and may be further transported to the outside of the appliance, particularly through an outlet opening.

In said compartment, preferably a cooling channel and/or cooling chamber, the fluid exhausted from the cavity is diluted, affecting measurably the relative humidity of the fluid within the compartment, preferably the cooling air stream in cooling channel and/or cooling chamber, itself.

The general concept underlying the household appliance, particularly an oven, and/or the method according to the present invention is thus, applicable and extendable to any system and/or household appliance, particularly where a stream of fluid, e.g. air, is flushing and diluting a stream of humid fumes from a closed environment. It is to be understood that said general concept underlying the appliance and/or the method according to the present invention may equally applied to a household appliance, particularly an oven, with or without steaming function, and particularly, also to the operation of a household appliance, particularly an oven, with steam function in a cooking process not applying said steam function. However, without being bound thereto, particular advantages of the present invention are apparent in connection with household appliances being ovens with such steam function.

It will be understood that a typical phase structure of a cooking operation may be used to support the humidity control according to the present invention.

A cooking process, particularly a steam cooking process, as used herein, preferably, comprises three steps:

A boost cycle, wherein—starting generally from room temperature—the oven is taken as quickly as possible to the temperature and/or humidity conditions set for the desired cooking operation, particularly for the following cooking cycle; a cooking cycle, wherein the temperature and/or humidity are to be controlled and kept as even as possible for a defined time lapse, and optionally, and particularly in a steam cooking cycle, a desteaming cycle, wherein, preferably in the last few minutes of the cooking operation, particular appliance operations, e.g. exhaust full opening, slight extra-heating, fan speed boost, or the like, are carried out to reduce the humidity content in the cavity before door opening by the user.

In connection therewith, it is to be understood, that such desteaming cycle is preferably mainly related to user comfort, and not to cooking performance. A desteaming cycle is particularly useful at the end of a steam cooking process. However, also in a non-steam cooking process, such boost cycle may be performed, as the initial heat-up of the cavity within the boost phase, as described above, by increasing temperature within the cavity, will lead to a generation of humidity, particularly by release of water and/or moisture contained in the foodstuff.

A person skilled in the art will immediately acknowledge that a de-steaming phase may also be advantageously applied at the end of non-steam cooking processes, for example by full exhaust opening. With regard to some kind of foodstuff, particularly foodstuff having a relatively high moisture content, e.g. apple pie, may benefit from such de-steaming cycle, in that a relatively high quantity of steam is generated even in non-steam cooking processes.

In connection therewith, it is also immediately understood by a person skilled in the art that the particular parameters of humidity and temperature within a boost cycle and a cooking cycle both may vary depending on the desired cooking process, foodstuff and program to be performed. Accordingly, it is desired to adjust and control the humidity level of a boost cycle and a cooking cycle of a cooking process. It is thereby particularly desired to control humidity during such cooking cycle.

The present invention allows adjusting and controlling the humidity level of a boost cycle and a cooking cycle of a cooking process.

Preferably, during a cooking operation of a household appliance, particularly an oven, according to the present invention and/or a method according to the present invention, said cooking operation comprises a boost cycle of heating and humidity build up in the cavity, more preferably to a predetermined and/or set temperature and/or humidity level within the cavity, a cooking cycle and, optionally, a desteaming cycle.

Such boost cycle may be performed by introducing steam into the cavity. However, such boost cycle, particularly in a household appliance, particularly an oven, without steam function, may also be performed. In such non-steam household appliance, particularly an oven, and/or non-steam cooking operation, such boost cycle, i.e. initial heating and humidity build up in the cavity, will be performed and achieved by the humidity generated by the foodstuff and/or bakery product itself.

In a further advantageous embodiment of method and/or the household appliance, particularly an oven, according to the present invention, said compartment comprises at least one mixing element for mixing and/or diluting a fluid from the cavity with air. Such mixing element further may advantageously allow for mixing fumes and/or humidity from the cavity with a significantly exceeding quantity of air, preferably in said compartment. A mixing element according to the present invention may preferably be a fan element.

Preferably, said compartment comprises at least one fan element for ventilating a fluid from and/or into said cavity.

It will be understood by a person skilled in the art that in order to practice the present invention it is advantageous to have a mixing element to mix and dilute fumes from the cavity with air, particularly a significantly exceeding quantity of air. Such flow including diluted gas preferably is the target of sensor measurement in the compartment. Such mixing element may.

In a further advantageous embodiment of method and/or the household appliance, particularly an oven, according to the present invention a sensor, particularly said at least one first sensor and/or said at least one second sensor is connected to a control unit, capable of controlling the input and/or output of a fluid from and/or into said cavity. Such controlling may be carried out by closing and/or opening of said at least one duct and/or operating a mixing element, preferably a fan element, and/or controlling a humidity controlling means. Such humidity controlling means, particularly in a household appliance such as an oven with steaming function may be provided in form of a humidity generating means, e.g. a steam generator or the like.

A control unit according to the present invention is advantageous in controlling and coordinating various operations of a household appliance. Particularly, such control unit is capable of controlling the input and/or output of said fluid from and/or into said cavity, preferably by closing and/or opening of said at least one duct and/or operating said fan element and/or controlling a humidity controlling means, particularly a humidity generating means, preferably a steam generating means, where the household appliance, particularly an oven, is a household appliance with steam function.

A humidity controlling means as used herein preferably refers to a means capable of generating steam and/or fresh air into the cavity, particularly capable of reducing or elevating humidity within said cavity. Such humidity generating means, preferably are selected from the group comprising humidity generating means, particularly steam generating means, e.g. steam generators, water bath, water ducts, or the like, valves for pressure and/or fluid outlets and/or inlets, particularly vapor and/or steam outlets and/or inlets, controls of water inlet means, e.g. shut-off valve means, or steam and vapor outlet adjustment means, valves and/or inlet and/or outlet ducts.

Particularly, in an embodiment of the present invention according to which the household appliance, particularly an oven, is a non-steam household appliance, and/or where such steam function is not operated, a humidity controlling means also comprises means for reducing the humidity, particularly the relative humidity, within the cavity, for example, outlet means for exhaustion of fluids from the cavity, particularly air and/or vapor and/or steam or mixtures thereof.

The term "input value" of a temperature sensor as used herein, preferably refers to a temperature measured by said temperature sensor.

The term "input value" of a humidity sensor, as used herein, preferably refers to a humidity value, preferably a relative humidity value, measured by said humidity sensor.

In a further advantageous embodiment of the method and/or the household appliance, particularly an oven, according to the present invention said at least one first sensor and/or said at least one second sensor is connected to a control unit, wherein said control unit is capable of correlating said input value of said at least one first sensor and/or said at least one second sensor to a humidity index value, preferably the humidity index value being selectable from a matrix comprising such humidity index value, more preferably said matrix being deposited in said control unit.

Correlating said input value of said at least one first sensor, and, optionally of said at least one second sensor, to a humidity index value being selectable from a matrix comprising such humidity index values, may be performed continuously during a cooking process, preferably continuously during a cooking cycle, of said household appliance. However, such correlating may additionally be performed during a boost cycle and/or at the end of such boost cycle operation of said household appliance.

It will be immediately understood by a person skilled in the art that such boost cycle comprises a humidity built-up within the cavity. However, such humidity built-up may be achieved with a steam introduction into the cavity or without such steam introduction into the cavity. In a non-steam household appliance, particularly an oven, or an operation without steam function, instead of a steam generator, such boost will be given by the humidity generated by the foodstuff itself.

To correlate said input value of said at least one first sensor and, optionally of said at least one second sensor allows to a humidity index value being selectable from a matrix comprising such humidity index value, allows to determine the humidity, particularly relative humidity within the cavity, based on estimation.

However, it is also considered herein that relative humidity of an environment may be influencing such measurement and/or correlation, particularly if being quite high. It is to be understood that this could in some cases prevent functionality of the estimation method according to the present invention, unless a specific procedure enables it. This, however, advantageously may be overcome by applying a boost cycle according to the present invention.

It is important to be understood that relative humidity of the fluid, particularly air, naturally present in the compartment, e.g. in a cooling airflow, is a parameter randomly related to environment conditions, particularly ambient conditions comprising ambient temperature and pressure. These ambient conditions, particularly if in connection with a relatively high relative humidity, may thus cause a "blind range" of the sensor.

During a boost cycle, the air is warmed up, advantageously reducing the baseline of relative humidity. Moreover, humidity is added to the monitored environment at the sensor position, advantageously generating conditions, preferably relatively similar, to the conditions desired during a cooking phase.

Accordingly, due to boost cycle a variable part of the measurement range, particularly before the effect of fluids, e.g. fumes, exhausting from the cavity into the compartment, on relative humidity in said compartment becomes visible to the sensor.

This particularly overcomes the disadvantage of approaches directly measuring the input values within the cavity. It will be immediately understood by the person skilled in the art that a direct approach to measurement is not feasible, and particularly that such correlation and set of a sensor measurement comprising consideration of the "blind range" of a sensor is advantageously applied according to the present invention.

In an embodiment of the method according to the present invention the method comprises a step of sensor blind range determination, preferably carried out during a boost cycle operation of said household appliance, more preferably at the end of a boost cycle operation, of said household appliance.

Such step of sensor blind range determination, preferably, comprising measuring an input value by the at least one first sensor and/or the at least one second sensor, and correlating said input value of said at least one first sensor and/or said at least one second sensor to a threshold value.

Advantageously, such threshold value determined by the method according to the present invention may allow to compute and consider the "blind range" of the sensor in further method steps, particularly during a correlation step according to the method of the present invention.

A person skilled in the art will immediately understand that, for example, by correlating said input value of said at least one first sensor and/or said at least one second sensor to such threshold value of said input value, particularly setting said threshold value to the measured input value and, particularly during a boost cycle operation of said household appliance, more preferably at the end of a boost cycle operation of said household appliance. This advantageously may allow exploiting said boost cycle operation to correlate and set said threshold, blind range of the sensor and particularly the "baseline" humidity level in the sensor location, particularly when located in the compartment.

Preferably, heating and humidity build-up in the cavity during a boost cycle is achieved using standard resistive heating elements and/or the steam generator, the steam generator preferably run at a fixed duty cycle. Accordingly, particularly at the end of the boost cycle the cavity will contain a certain, defined, preferably pre-defined, humidity level and a set temperature. It will be immediately understood that a warming up of the cavity, and particularly the oven, will also result in a warm up of the fluids, particularly air, in the technical volumes.

A technical volume as used herein preferably refers to any available volume in between a cooking cavity and an external case of the household appliance, particularly an oven, according to the present invention. More preferably, in such technical volume electrical and mechanical components are located, most preferably not accessible by a user. Preferably, in such technical volume cooling airflow happens.

Accordingly, the rise in temperature of the fluid, particularly air, in said technical volumes reduces immediately the humidity uptake capacity of the air itself, more particularly the instantaneous air content of humidity, thereby also shrinking significantly the "blind range" of the sensor. It will be immediately understood that the air in the compartment, particularly a cooling air channel, is heated as a side effect, as heat from the cavity is introduced into said compartment. As warm air has a higher capacity for moisture uptake, accordingly, the relative humidity—with basically the same moisture content—is less.

In a further advantageous embodiment of the method and/or the household appliance, particularly an oven, according to the present invention said at least one first sensor and/or said at least one second sensor is connected to a control unit, wherein said control unit is capable of correlating said input value of said at least one first sensor and/or said at least one second sensor to a humidity index value, said correlation comprising

- comparing said input value of said at least one first sensor and/or said at least one second sensor to a matrix comprising such humidity index value, preferably deposited in said control unit, and
- comparing said humidity index value to a set humidity value, and
- determining and/or generating an output signal for controlling a humidity controlling means, particularly a humidity generating means, preferably a steam generating means.

A set humidity value is preferably set according to the desired conditions of the cooking process. It will be immediately understood that such set humidity value may be set by the user directly. For example, by selecting the desired humidity value. However, a household appliance, particularly an oven, according to the present invention may also, particularly in its control unit, comprise default receipts, for example, for different kind of foodstuff and/or cooking processes. It will be also understood that desired humidity value during a boost cycle and desired humidity value during a cooking cycle may be independently set.

The set humidity value is preferably set by the user, like other cooking conditions, e.g. temperature and time, of a desired cooking process, depending on the specific cooking process to be performed. The boost cycle set value is preferably chosen such that the humidity value within the cavity at the end of the boost cycle is similar to the set humidity value of the cooking cycle.

The closed loop control realized by the method according to the m present invention advantageously ensures to keep the humidity value within the cavity near the set humidity value.

It will be understood that a set humidity value may thus act as a control parameter for the closed loop control of humidity within the cavity realized by the method according to the present invention, particularly during a cooking cycle. The control unit, its algorithm according to the method of the present invention, and the correlation according to the present invention advantageously allows continuous estimation of the actual humidity level within the cavity. Based on sensor measurement of an input value of said at least one first sensor and/or said at least one second sensor, said input values of said at least one first sensor and/or said at least one second sensor is correlated to a humidity index value by comparing said input value of said at least one first sensor and/or said at least one second sensor to a matrix comprising according humidity index values, preferably deposited in said control unit. The humidity index value correlated from the matrix to the sensor input values, represents an estimation of the actual humidity within the cavity. Comparing said humidity index value to a set humidity value allows for determining and/or generating an output signal for controlling a humidity controlling means. Accordingly, the actual humidity value within the cavity is continuously adjusted to correspond to the set humidity value.

In an embodiment of the method and/or the household appliance, particularly an oven, according to the present invention said at least one first sensor and/or said at least one second sensor is connected to a control unit, capable of correlating said input value of said at least one first sensor and/or said at least one second sensor to a humidity index value, said correlation comprising comparing said input value of said at least one first sensor and/or said at least one second sensor to a matrix, preferably deposited in said control unit, and generating an output signal, preferably an index humidity value, more preferably an estimated index humidity value, for controlling a humidity controlling means, particularly a humidity generating means, preferably a steam generating means.

The sensor, particularly the at least one first sensor, preferably a first humidity sensor, and/or said at least one second sensor is, preferably, starting its measurement of its input value, particularly of the humidity in the compartment, preferably in the cooling air flow where the compartment is a cooling chamber or cooling channel, from the end of the boost cycle and, more preferably continuously performs said measurement, all over the cooking operation, particularly during the cooking cycle.

Accordingly, in an embodiment of the present invention, wherein the household appliance, particularly an oven, is a household appliance, particularly an oven, with steam function, the activation of a steam generator by the control unit may be controlled according to the correlated humidity index value or estimated humidity index value deduced from the sensor input value(s) by correlation.

It will be immediately understood by a person skilled in the art that a cooking cycle operated in a household appliance, particularly an oven, according to the present invention a set humidity value will be set, preferably by the user, and continuously compared to the humidity index value correlated from the matrix based on the continuously measured sensor input value(s). Whenever the humidity index value as correlated from the matrix based on the measurement of the at least one first sensor and/or the at least one second sensor will exceed the set humidity value, the humidity controlling means, particularly humidity controlling means for reducing the humidity in the cavity may be operated, particularly to recover an appropriate humidity level.

In this way, a household appliance, particularly an oven, according to the present invention, and particularly also a household appliance, particularly an oven, according to the present invention without a steam function and/or operated without a steam function, e.g. a standard oven, is provided by the present invention with an efficient humidity abatement system, particularly for optimizing cooking cycles having this particular need, and also to reduce and/or eliminate the steam and/or vapor cloud occurring upon door opening.

In connection with the method according to the present invention and/or the appliance according to the present invention, it is particularly considered herein, to perform a step of humidity control, preferably repeatedly and or continuously during a cooking operation, particularly during cooking cycle and, optionally during a desteaming cycle, of said household appliance.

Accordingly, in a household appliance, particularly an oven, according to the present invention and/or a method according to the present invention the steps of i) measuring an input value by the at least one first sensor and/or measuring an input value by the at least one second sensor;

ii) correlating said input value of said at least one first sensor and/or said at least one second sensor to a humidity index value from a matrix, wherein said matrix comprises such humidity index value, preferably said matrix being deposited in a control unit of the household appliance; said correlation comprising comparing said input value of said at least one first sensor and/or said at least one second sensor to the matrix;

iii) comparing said humidity index value from step ii) to a set humidity value for a boost cycle and/or a cooking cycle and/or a de-steaming cycle of a cooking process from step a); and iv) determining and/or generating an output signal for controlling a humidity controlling means, particularly a humidity generating means, preferably a steam generating means; and v) controlling said humidity controlling means and generating a humidity value in the cavity according to the output signal, may be each individually or mutually and/or simultaneously or consecutively, performed repeatedly and/or continuously during a cooking operation, particularly during a cooking cycle and, optionally during a desteaming cycle, of said household appliance.

The present invention thus provides a household appliance, particularly an oven, and method capable of advantageously controlling humidity in a cavity of a/said household appliance, particularly an oven, by deducing a humidity index related to humidity content in the oven cavity. More particularly, as an input value a value measured by the at least one first sensor, preferably a humidity value, more preferably a relative humidity value, of the fluid contained in the compartment, preferably in the cooling air stream of a cooling channel and/or cooling chamber, is used, whereby said fluid, preferably said cooling air stream of a cooling channel and/or cooling chamber, is mixed with a fluid, particularly mixed with fumes, from the cavity.

It is to be understood that, the humidity index value contained in and correlated from the matrix is used for determining and/or generating an output signal for controlling a humidity controlling means and, thus to control the humidity in the cavity, preferably based on an estimation, which is based upon a real humidity measurement and the oven cavity temperature, wherein the oven cavity temperature is measured as an input value by the at least one second sensor.

It will be thus understood that, particularly said at least one first sensor connected to a control unit will measure, preferably repeatedly or continuously during a cooking cycle, the input value, preferably the humidity value as its input value. Preferably, also said at least one second sensor, a temperature sensor, is connected to said control unit and measures, preferably continuously during a cooking cycle, the temperature value as its input value. The control unit is correlating said input values of said at least one first sensor and, preferably, of said at least one second sensor, to a humidity index value. This preferably is achieved by comparing said input value(s) of said at least one first sensor and/or said at least one second temperature sensor to a matrix, preferably deposited in said control unit. Accordingly, an output signal, preferably an index humidity value, more preferably an estimated index humidity value, is generated based on said correlation, which is used for controlling a humidity controlling means, particularly a humidity generating means, preferably a steam generating means.

A matrix as used herein, comprises humidity index values and, is deposited in a control unit of the household appliance.

Said correlation of the input value(s) with said index humidity value may be based on simple a lookup table forming said matrix, preferably a 2D matrix. In such matrix, for example, columns may represent ranges of temperature, e.g. split in steps of 10° C., preferably, over the overall temperature working range of the household appliance. Rows in such matrix may indicate the humidity index, for example, ranging from a relative humidity value of 0% to 100%, for example, in steps of 10%. The matrix itself may be then filled and populated with sensor values, serving as reference to the actually measured values.

Such matrix, particularly the correlation of actual sensor values in dependence of temperature ranges to said humidity index values, may be advantageously achieved experimentally by a set of tests using a reference sensor and/or an already present second sensor placed in the cavity.

Preferably, the method according to the present invention comprises a step of correlating an input value of an at least one first sensor and/or of an at least one second sensor to a humidity index value and/or the household appliance, particularly an oven, according to the present invention comprises a control unit capable of correlating an input value of an at least one first sensor and/or an at least one second sensor to a humidity index value. Thereby, said correlation of said input value of said at least one first sensor and/or said at least one second sensor to a humidity index value, preferably occurs, during, more preferably continuously during, a cooking cycle operation of said household appliance. Such correlation, preferably, comprises comparing said input value of said at least one first sensor and/or said at least one second sensor to a matrix, preferably deposited in said control unit. Said control unit, preferably, is capable of generating or generates an output signal assessed by said correlation, preferably a humidity index value or estimated humidity value, and thus is capable of controlling a humidity controlling means, particularly a humidity generating means, preferably a steam generating means, according to said output value and/or correlation.

In a particularly preferred embodiment such correlation and determination of the output value, in other words the deduction of the humidity index value from said measured input value(s), may be achieved by three consecutive or simultaneous steps:

A second input value is measured by the at least one second sensor capable of measuring said second input value, wherein said second input value is a temperature value, preferably in the cavity. This may advantageously achieved by a standard cavity temperature sensor. The appropriate correlation matrix column is selected according to said measured second input value.

The at least one first sensor, capable of measuring a first input value, wherein said first input value preferably is a humidity value, preferably a relative humidity value, i.e., for example, an actual humidity value within the compartment. This first input value measured by the at least one first sensor is assigned to the appropriate value in the selected matrix column, said selected matrix column selected from the correlation matrix column according to said measured second input value. More preferably, said appropriate value is a value proportional to the second input signal, preferably relative humidity value, measured as an input signal by the at least one first sensor in the compartment, particularly in a cooling air stream of an air cooling channel and/or cooling chamber. Thereby, a value in the selected column may be identified, being the most similar value in the selected correlation matrix column.

Finally, according to said selection of the appropriate value in the selected matrix column, a respective humidity index value, preferably estimated humidity index value, may be assigned as an output signal.

Said output signal may be than used to control various operations of the household appliance, particularly, for controlling a humidity controlling means, particularly a humidity generating means, preferably a steam generating means. However, further other operations may be controlled based on said output signal, for regulating and/or controlling the humidity and/or temperature in the cavity. Particularly, controlling of a heating element, a steam generator means, valves for pressure and/or fluid outlets and/or inlets, particularly vapor and/or steam outlets and/or inlets, control of water inlet means, e.g. shut-off valve means or steam and vapor outlet adjustment means, valves and/or inlet and/or outlet ducts.

It will be understood by a person skilled in the art that the methods and/or household appliances according to the herein described embodiments of the invention advantageously allow the possibility to combine different conditions of humidity during different phases of a cooking operation, particularly during boost cycle and/or cooking cycle. Such operations are advantageously controlled and/or tunable by the duty cycle of the steam generator, particularly in the boost cycle, and the humidity value desired and/or achieved during a cooking cycle. Said humidity values within the cavity may be advantageously controlled and/or monitored by the method and/or household appliance, particularly an oven, according to the present invention. Said humidity values are particularly used to control a humidity controlling means, particularly a humidity generating means, preferably a steam generator operation, in closed loop.

To date, according to the prior art humidity and/or steam generation is usually carried out in an open loop, i.e. the generator is actuated with a fixed duty cycle tuned in standard conditions, regardless of the actual humidity level reached. In connection therewith, it will be immediately understood that a reason for estimating and/or correlating a humidity index value from the matrix, as described in the present invention is to enable control of the humidity inside the cavity during a cooking process in closed loop, adapting the behavior of the steam generation upon real need of steam/humidity.

In this way, it is possible to deliver and/or to control the desired right amount of humidity for each cycle of a cooking process. In connection therewith, it is to be understood that it is, according to the receipt and cooking process to be performed, often important and desired, particularly in an early phase of a cooking process, particularly in a boost cycle and/or in an early phase of the cooking cycle, to achieve special, specific or different conditions with respect to the rest of the cooking process itself. Particularly, where a relatively dry cooking condition within the cavity is desired, the method and/or appliance according to the present invention may advantageously applied.

In connection with the various embodiments of the methods and/or the household appliance, particularly an oven, according to the present invention, particularly, a household appliance, particularly an oven, according to the present invention or method may comprise a setting means or the operation thereof. Said setting means may be connected to said control unit and, preferably being adapted to set a pre-definable set humidity value and/or set temperature value and/or receipt.

Such setting means may advantageously be connected to a control unit and/or a display and/or user interface of the household appliance, in order to facilitate an input of said set humidity value and/or set temperature value and/or receipt by a user.

For example, a receipt may be stored in the control unit, or a storage device, of the household appliance, which allows a user to select said receipt according to the desired foodstuff or category of foodstuff and/or cooking conditions. For example, different receipts and/or foodstuff or categories of foodstuff may be displayed in a user interface for selection by the user.

According to different receipts, desired foodstuff or categories of foodstuff, different set humidity values may be stored and/or may be selected or selectable, for different phases of a desired cooking process. For example, a set humidity value for a boost cycle of a cooking process may be stored and/or selectable according to the desired receipt, desired foodstuff or categories of foodstuff to be cooked, and a set humidity value for a cooking cycle phase of the cooking process may be stored and/or selectable according to the desired receipt, desired foodstuff or categories of foodstuff to be cooked. For example, a food category such as "puddings or terrines" may be selectable, whereby a relatively high set humidity value during a boost cycle and a relatively high set humidity value during a cooking cycle of the cooking process is stored and selected, selectable or suggested. A further food category such as "casseroles and Lasagne" may be selectable, whereby a relatively low set humidity value during a boost cycle and a relatively low set humidity value during a cooking cycle of the cooking process is stored and selected, selectable or suggested.

Accordingly, and dependent on the desired receipt, desired foodstuff or categories of foodstuff, different set humidity values may be combined for the different phases of a cooking process, particularly for the boost cycle and/or the cooking cycle of such cooking process. Such different combination may be stored and/or proposed and/or adjustable and/or selectable by the user, and may particularly be proposed by a display and/or user interface for specific categories of food, desired receipt, and desired foodstuff.

Additionally or alternatively, a household appliance, particularly an oven, and/or a method according to the present invention may comprise control of temperature within the cavity, and particularly the possibility to adjust and/or select a set temperature value, by the user or stored as part of a cooking receipt or program, as known from household appliances known in the prior art.

Accordingly, a control unit may also be adapted to automatically determine and maintain inside the cavity the degree of humidity and/or a temperature. For example, as pre-defined by said setting means and/or correlated by the method and/or appliance according to the present invention, by acting on, for example, a heating element, a steam generator means or water inlet shut-off valve means or steam and vapor outlet adjustment means, valves and/or inlet and/or outlet ducts.

A household appliance, particularly an oven, according to the present invention preferably is a domestic household appliance. Preferably, a household appliance, particularly an oven, according to the present invention is selected from the group comprising cooking oven with or without steam function, steam oven, steam-cooking oven, smoker, rice cooker, countertop steamer, microwave and/or specialized ovens and/or specialized muffle categories, selected from the group comprising bread dough proving chamber or the like.

Particularly, a household appliance, particularly an oven, according to the present invention may comprise a steam generator means and/or a shut-off valve for letting steam, vapor and/or water or a mixture thereof into the cavity and/or an adjustment means for adjusting gas and vapor outlet from the interior to the exterior of said cavity. Particularly, a household appliance, particularly an oven, according to the present invention may comprise a steam-generating unit arranged to supply the cavity with water steam.

In a further advantageous embodiment of the method and/or the household appliance, particularly an oven, according to the present invention said at least one duct is in fluid communication with the compartment and said cavity, through at least one outlet opening of said cavity for exhaustion of air and/or vapor and/or steam or a mixture thereof, out of the cavity into said compartment, and/or through at least one inlet opening of said cavity for influx of air and/or vapor and/or steam or a mixture thereof, preferably generated by said mixing element, preferably a fan element and/or a humidity controlling means, particularly a humidity generating means, preferably from said compartment into the cavity, wherein, preferably, said at least one duct can be opened or closed by at least one valve, preferably a throttle valve and/or an electric valve.

Such configuration particularly allows a fluid communication between the compartment, preferably a cooling channel and/or a cooling chamber and the cavity.

More particularly, through such at least one outlet opening of said cavity, air and/or vapor and/or steam or a mixture thereof may exhaust from the cavity into said compartment.

Through such at least one inlet opening of said cavity air and/or vapor and/or steam or a mixture thereof may influx into said cavity, preferably from said compartment.

It is particularly preferred that air and/or vapor and/or steam or a mixture thereof is streamed in and/or out of the cavity by generating a stream by a fan element and/or a humidity controlling means, particularly a humidity generating means. Thereby, said at least one duct, preferably an inlet and/or outlet duct may be advantageously arranged in fluid communication with both, the cavity and the compartment. Particularly, such duct may be opened or closed by at least one valve, preferably a throttle valve and/or an electric valve.

In a further advantageous embodiment of the method and/or the household appliance, particularly an oven, according to the present invention said at least one outlet opening is arranged in an upper area of the cavity, preferably an upper wall and/or wherein the inlet opening is arranged in a lower bottom area of the cavity, preferably a bottom wall of the cavity and/or a side wall of the cavity, preferably a bottom wall of the cavity.

The arrangement of the at least one outlet opening in an upper area and/or of the inlet opening in a lower bottom area of the cavity may be advantageously chosen by a person skilled in the art depending on the desired effect.

Particularly, an arrangement of the at least one outlet opening in an upper area and of the inlet opening in a lower bottom area of the cavity may be advantageous, as such mutual arrangement of at least one outlet opening in an upper area and of the inlet opening in a lower bottom area of the cavity provides a distance between the at least one outlet opening and the inlet opening sufficient to substantially prevent a fluid dynamic short circuit.

Hence, the arrangement of the at least one outlet opening in an upper area and/or of the inlet opening in a lower bottom area of the cavity may be advantageously influence, particularly reduce or enhance a cavity flushing effect according to the particular needs.

In a further advantageous embodiment of the method and/or the household appliance, particularly an oven, according to the present invention said at least one mixing element, preferably a fan element, is located in fluidic connection with said compartment and/or wherein said at least one mixing element is a fan element, preferably a radial or a tangential fan and/or a motor-driven fan.

Such fan may be advantageously placed in said compartment, particularly, said compartment or a part thereof may be configured in form of a cochlea, particularly a fan cochlea.

In connection therewith, it is to be understood that a positioning and/or arrangement of such mixing element, particularly a fan element, may be chosen according to the desired purpose. It is further to be understood that a person skilled in the art is able to choose such positioning and/or arrangement of such at least one mixing element at a position appropriate for the desired needs and depending on the particular geometry of said compartment, particularly a position may be chosen, where fumes, particularly resulting from an overpressure in the cavity, from the cavity are effectively diluted by an ambient air flow, particularly in terms of temperature and relative humidity value of such resulting air/fume mixture. In other words, in an embodiment, a fan element, particularly a cooling fan, may be advantageously provided and function as a mixing element according to the present invention, as such fan element is an almost ubiquitous feature in domestic built-in ovens. More particularly, a discharge channel of such fan element may be advantageously applied and used as the position and target area of an at least one first sensor capable of measuring a first input value, according to the present invention.

In a further advantageous embodiment of the method and/or the household appliance, particularly an oven, according to the present invention, said fluid is air, fresh and/or cold air, steam, vapor and/or a mixture thereof.

It will be immediately understood that the term "fluid" as used herein is used in its most general meaning. However, a person skilled in the art will immediately understand that in particular combinations and embodiments a certain fluid is considered appropriate. For example, fresh, and particularly cold, air may be used for cooling purposes, whereas steam and/or vapor is used for introducing moisture and/or heat into the cavity. In particular, embodiments of the present inventions a mixture of different fluids is also considered. For example, when steam, moisture and/or vapor is introduced into the compartment from the cavity, and said compartment comprises fresh air for cooling purposes, a mixture will be achieved. It will also be understood that various parameters, particularly humidity and/or pressure and/or temperature of such mixture may be advantageously measured according to the present invention. Particularly, the measuring of an input value of a sensor located in the compartment, may measure its input value in a mixture of different fluids.

In a further advantageous embodiment of the method and/or the household appliance, particularly an oven, according to the present invention said at least one second sensor is located in the cavity, preferably in a cavity wall, more preferably in an upper cavity wall, or is located in the compartment, or wherein an at least one second sensor is located in the cavity, preferably in a cavity wall, more preferably in an upper cavity wall, and at least one further second sensor is located in the compartment.

In connection therewith, it is to be understood that the positioning of said at least one second and/or said at least one further second sensor depends on the measurement to be performed. Particularly, an at least one second sensor placed in the cavity, will measure its input value, particularly temperature, within the cavity, whereas an at least one further second sensor placed in the compartment, will measure is input value, particularly temperature within the compartment. Both, individually or in combination is considered herein.

Such at least one second and/or at least one further second sensor may also be operably connected to a thermostat means, and/or to a control unit for controlling temperature in the cavity and/or the compartment, respectively.

In a further advantageous embodiment of the method and/or the household appliance, particularly an oven, according to the present invention said household appliance, particularly an oven, comprises at least one further sensor located in the cavity, preferably in a cavity wall, more preferably in an upper cavity wall, and, wherein preferably said at least one further sensor is connected to a control unit, wherein the at least one further sensor is capable of measuring a humidity value, preferably a relative humidity value, and/or a pressure value, within said cavity as an input value of said at least one further sensor.

Such at least one further sensor may be additionally to the at least one first sensor be applied and located in a cavity of a household appliance, particularly an oven, according to the present invention or operated in a method of the present invention. Such at least one further sensor is capable of measuring a humidity value and/or a pressure value within said cavity, which advantageously may be used to configure and/or determine a matrix, and/or to control directly the actual humidity value within said cavity. However, such at least one further sensor placed in the cavity is prone to direct heat and moisture exposure and thus may be chosen of higher quality and/or additionally equipped with elements preventing damage from such exposure.

All described embodiments of the invention have the advantage, that control of steam generation is allowed, closing loop on humidity measurement, particularly, by the use of a relatively cheap sensor, whose use is allowed by the chosen measurement position. In other words, as the at least one first sensor is placed in the compartment located exterior to the oven cavity, said at least one first sensor is not directly exposed to the heat and/or moisture within the cavity. Moreover, by a specifically developed boost cycle at the beginning of a cooking operation.

In connection therewith, it is to be understood that a boost cycle as used herein allows to include the use of the steam generator with a fixed duty cycle. Thereby, it is possible to reach a starting point for steady state control—in a closed loop—of humidity inside the cavity. As such boost cycle has an impact on the cooking performance, particularly due to a different speed of a cavity saturation, it is also possible to create a more optimal cooking process, comprising such boost cycle and a cooking cycle, and particularly combining the setting of an appropriate boost cycle and an appropriate humidity level, particularly according to a set humidity value(s).

Moreover, correlating the input value of an at least one first sensor and/or of an at least one second sensor to a humidity index value from a matrix, wherein said matrix comprises such humidity index value(s), advantageously provides an easy to calibrate and easy to use matrix, particularly possible in the form of a lookup table, and advantageously allows such correlation between sensor reading and a humidity index in the cavity, particularly usable for a closed loop control of steam generation during cooking cycles. The humidity control strategy according to the present invention is therefore advantageously based on a boost and a relaxation control. In other words, a boost cycle usually may performed to raise the humidity level in the cavity up to a set humidity value that is near or exceeding the selected set humidity value of the cooking cycle. Accordingly and advantageously, a control does not have in this way to take care of the bulk build-up of humidity, but it can be effectively calibrated to recover to the desired value humidity as it goes below the value itself. In other words, a relaxation control is advantageously achieved.

Particularly, according to the present invention it is possible to derive indications about the atmosphere inside the cavity without a direct measurement preformed on air and/or liquid inside or taken from the cavity as such. More particularly, the present invention is independent from a dedicated oven sampling, as it advantageously exploits existing structures of the appliance, where a dedicated mixing system is preferably neither provided nor needed. An effective, reliable, cheap and non-invasive solution, easily applicable on most household built-in ovens, allowing closed loop control of humidity during cooking is thus achieved.

In connection with the household appliance, particularly an oven, and/or the method according to the present invention it will be immediately understood that a key point of the invention and its various embodiments is that the first sensor outside of the cavity itself is not used to measure the actual humidity value in the cavity, however, said first sensor is used to measure an input value that has to be used in a correlation process to deduce an humidity index for the inside of the cavity.

Further features of, and advantages with, the present invention will become apparent when studying the appended claims and the following description. Those skilled in the art realize that different features of the present invention may be combined to create embodiments other than those described in the following, without departing from the scope of the present invention, as defined by the appended claims.

The present invention will be described in further detail with reference to the drawings from which further features, embodiments and advantages may be taken, and in which FIG. 1 illustrates a schematic figure showing a cross sectional view through a cavity of a household appliance showing a first inventive embodiment;

Figure 1:
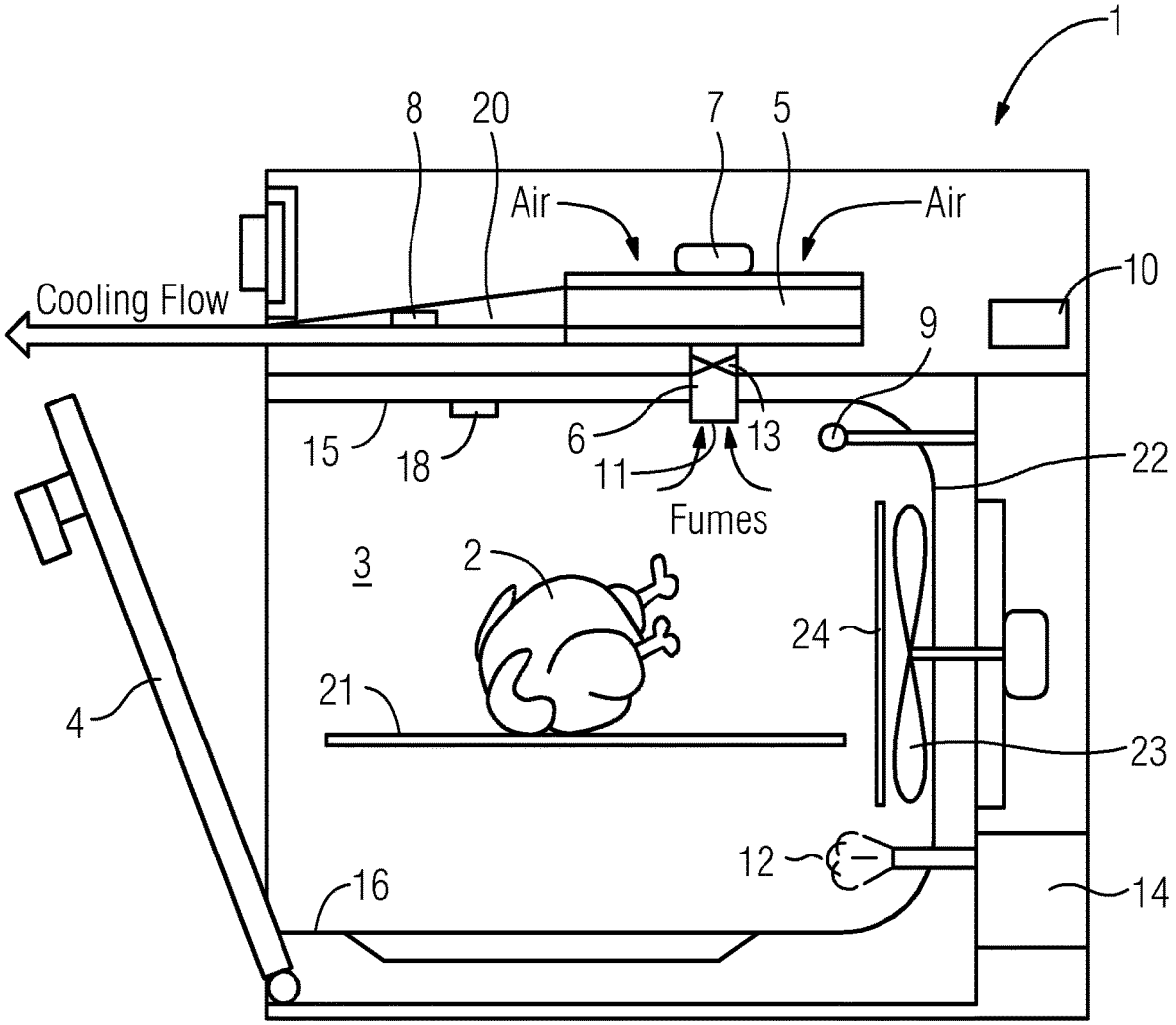

FIG. 1 illustrates a schematic figure showing a cross sectional view through a cavity 3 of a household appliance 1 showing a first inventive embodiment, here a steam-cooking oven 1.

In the following detailed description of the present invention, reference is made particularly to said household appliance being a steam-cooking oven 1 capable of a steaming function by introducing water or steam into the cooking cavity to create special food cooking conditions.

However, it will be appreciated that what is described and claimed here equally applies to any other type of household appliances for cooking and/or baking food stuffs or bakery ware, particularly a household appliance, more particularly an oven, without such steam function and/or operated without applying such steam function, with the slight modification that during a boost cycle, a humidity build-up is achieved by moisture from the foodstuff itself. Therefore, it is to be understood that what is described and claimed here according to a particular cooking oven with steam function, particularly, also is applicable—with only slight modifications known to a person skilled in the art and described herein—to any other type of household appliances for cooking and/or baking foodstuffs or bakery ware, particularly without such steam function and/or without operating such steam function, and is considered herein within the scope of the present invention.

A household appliance 1 for cooking and/or baking food stuffs or bakery ware 2 according to the present invention comprises a heatable cavity 3 for placing the food stuffs or bakery ware 2, which may be placed on a grid or tray 21, an access door 4 for accessing the cavity 3, a compartment 5 located exterior of said cavity 3, said compartment being in fluid communication with said cavity 3 by at least one duct 6, at least one first sensor 8 capable of measuring a first input value, wherein said first input value is a humidity value or a pressure value, and at least one second sensor 9 capable of measuring a second input value, wherein said second input value is a temperature value. Such household appliance 1 may further comprise a central fan 23, for example, as a convection fan, which may be located in or adjacent to a cavity rear wall 22. Such central fan 23 may comprise a fan shield 24.

In such household appliance 1 the at least one first sensor 8 is located in the compartment 5. The at least one first sensor 8 capable of measuring a first input value, is a humidity sensor 8, and said first input value is a humidity value within said compartment 5, preferably a value of relative humidity. Said compartment 5 comprises at least one mixing element 7, here a fan element 7 in form of a main cooling fan, for mixing and/or diluting a fluid, here fumes, from the cavity 3 with air, particularly with a significantly exceeding quantity of air.

Said compartment 5 here in the form of a cooling chamber, and particularly the cochlea of said main cooling fan 7 comprises said at least one fan element 7 for ventilating a fluid from and/or into said cavity 3. Particularly, said main cooling fan 7 ventilates a cooling airflow out of the appliance, and sucks in fresh ambient air for cooling the appliance. Through the duct 6, fumes are escaping the cavity into the cooling chamber 5.

Said at least one first sensor 8 and said at least one second sensor 9 are connected to a here not shown control unit 10, capable of controlling the input of air and/or steam into and the output of fumes from said cavity 3, preferably by closing and/or opening of said at least one duct 6, for example by a valve, and/or operating the mixing element 7, and/or controlling a humidity controlling means 14, here a humidity generating means in the form of a steam generator 14.

As may be seen best from FIG. 1 said compartment 5 being a cooling chamber, and preferably a part of the cochlea 20 of the fan 7, and said at least one first sensor 8 is located at a position exposed to temperatures of about 100° C. or less and exposed to relative humidity of about 100% or less during operation of said household appliance 1.

The compartment 5 is a cooling channel and/or a cooling chamber, preferably an oven-cooling channel and said compartment 5 is located exterior of said cavity 3, particularly said compartment 5 is located on top of said cavity 3.

The at least one duct 6 is in fluid communication with the compartment 5 and with the cavity 3, through the at least one outlet opening 11 of said cavity 3 for exhaustion of fumes, air and/or vapor and/or steam or a mixture thereof, out of the cavity 3 into said compartment 5.

Additionally, the cavity 3 comprises an at least one inlet opening 12 for influx of steam or a mixture of steam and air. Said mixture may also be generated and/or ventilated by said fan element 7 and a steam generator 14, as a humidity generating means 14. Air may also be vented by the fan 7 from said compartment 5 also into the cavity 3, preferably mixed with steam from the steam generator 14. Said at least one duct 6 may be opened or closed by a here not shown at least one valve 13, which may be preferably a throttle valve and/or an electric valve.

The at least one outlet opening 11 is arranged in an upper area 15 of the cavity 3, particularly in an upper wall 15 and the inlet opening 12 is arranged in a lower bottom area 16 of the cavity 3, particularly in a bottom wall 16 of the cavity 3.

The main cooling fan 7 being the mixing element 7 is located in fluidic connection with said compartment 5. The main cooling fan 7 may be configured as a radial or a tangential fan, particularly a motor-driven fan, driven by a motor 25.

As may be taken from FIG. 1 the inlet opening 12 is for input of steam or an air/steam mixture as a fluid into said cavity 3. Moreover, the outlet opening 11 is for output of fumes as fluid from said cavity 3.

The at least one second sensor 9 is located in the cavity 3, here in or adjacent to the cavity rear wall 22.

Figure 2:
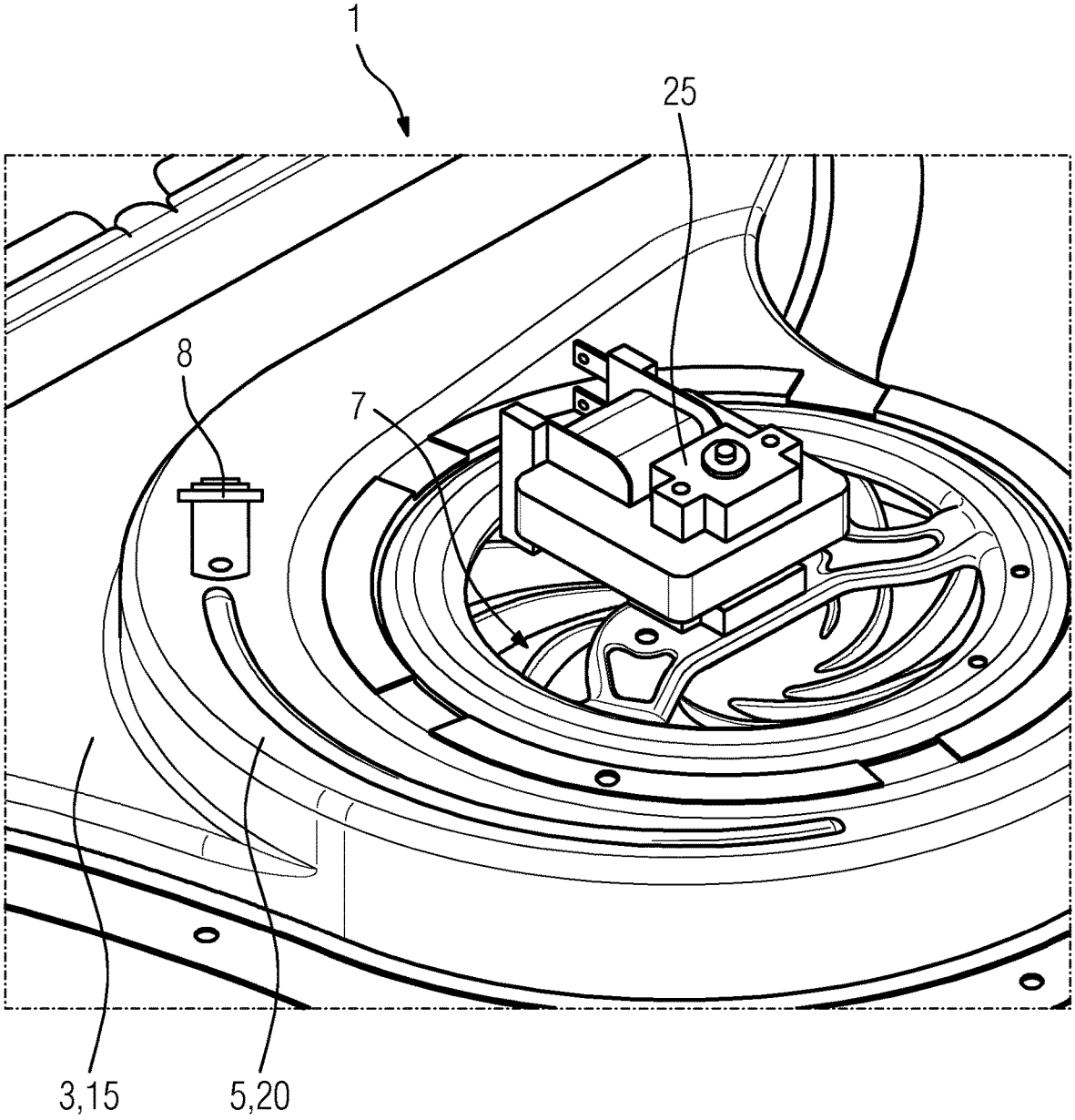
FIG. 2 illustrates a detailed perspective top view of a cavity and compartment of a household appliance showing the first inventive embodiment.
Figure 3:
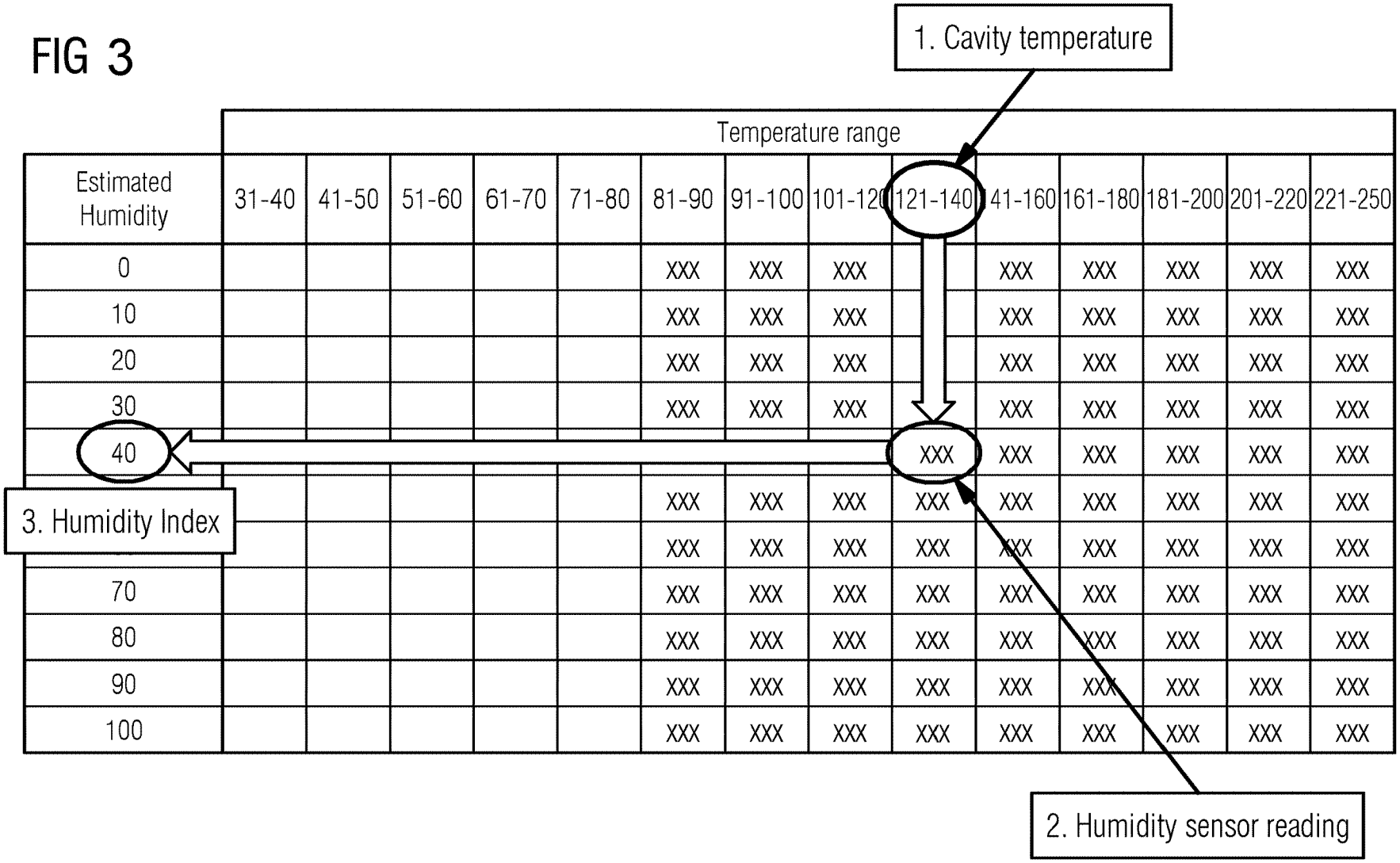
FIG. 3 illustrates an exemplary matrix for use in connection with the present invention.

In FIG. 2, particularly a detailed top view of a heatable oven cavity 3 comprised in said steam-cooking oven 1 according to the first inventive embodiment is depicted. FIG. 3 shows a detailed sectional view of said cavity 3 and, particularly of said compartment 5 of said household appliance 1 showing the first inventive embodiment. Here the exhaust duct and its throttling valve 27 are evident, particularly comprising a throttling valve actuator 26 and an exhaust manifold from oven cavity 28.

Said heatable cavity 3 is closed by a, here not shown, frontal access door 4. Foodstuff and/or a bakery ware 2 may be placed in a central region of the oven cavity 3. Usually oven cavities comprise means 21 for positioning foodstuff and/or a bakery ware, such as grids or trays, in different defined vertical positions, such as guiding rails or lateral embosses.

The oven cavity 3 comprises several cavity walls (15, 16, and 17) such as a rear wall 22. Here in the detailed top view of FIG. 2, only the upper cavity wall 15 is visible. In the embodiment of the household appliance 1 according to the present invention a compartment 5 in form of a cooling chamber and/or cooling duct is located exterior of said cavity 3, particularly on top of said cavity 3. Said cooling chamber 5 is at least partially formed as a cochlea 20 and cooling fan exhaust duct, also comprising the main cooling fan 7 as a fan element 7, here a convection fan 7. The compartment 5 and the fan element 7 are configured and arranged such, that a flow of cooling air generated by the convection fan 7 is directed in defined directions, particularly into the oven cavity and to the outside, i.e. transporting fresh air to the cavity and transporting used air/steam to the outside.

Particularly, the compartment 5 is arranged in fluid communication with said cavity 3 by, the here not shown at least one duct 6. The fan element 7 thus is capable for ventilating a fluid, e.g. fumes from the cavity 3.

It can be immediately seen, that said cooling chamber and/or cooling channel 5, and thus the first sensor 8 is located at a position usually exposed to temperatures of 100° C. or less and to a relative humidity of usually 100% or less during operation of said household appliance 1, here within the cooling fan exhaust duct.

Such household appliance 1 may comprise a steam generating means 14, as a humidity controlling means, particularly a humidity generating means 14, besides other humidity controlling means, particularly a humidity generating means 14 capable of generating steam and/or fresh air into the cavity, particularly capable of reducing or elevating humidity within said cavity. Such humidity controlling means 14, particularly a humidity generating means 14, may be selected from the group comprising steam generating means, e.g. steam generators, water bath, water ducts, or the like, valves for pressure and/or fluid outlets and/or inlets, particularly vapor and/or steam outlets and/or inlets, controls of water inlet means, e.g. shut-off valve means, or steam and vapor outlet adjustment means, valves and/or inlet and/or outlet ducts. Particularly, as a steam generating means 14, a liquid container of a steam generator may be formed to a bottom wall 16 of the oven cavity 3. Such liquid container of the steam generator 14 may be filled with a liquid, e.g. water, which can be evaporated by means of a heating element provided by the steam generator 14. An outlet duct 6 nay be formed by the liquid container, which allows the evaporated steam to reach a central region of the oven cavity 3.

The convection fan element 7 can be controlled and operated such that a fan operation is ensured over the complete cooking cycle with a fan speed sufficient to for ventilating a fluid from and/or into said cavity 3. The fan rotation speed or the rotation direction can be varied to further improve ventilating, and particularly steam stirring and even distribution, if desired.

According to the embodiment shown in FIGS. 1 and 2 a first sensor 8 being a humidity sensor for measuring relative humidity value as its input value, is arranged in the compartment 5 located exterior of said cavity 3, here in the cochlea area 20. Said first humidity sensor 8 is capable of measuring humidity, particularly relative humidity, within said compartment 5 at the sensor position, as an input value of said sensor 8. The household appliance 1 further comprises a temperature sensor 9 within the cavity 3. In connection with such temperature sensor 9, usually a recalibration algorithm is provided to convert the reading in whatever physical location of the sensor in the oven into the corresponding temperature in oven cavity center. Accordingly, a person skilled in the art will know how to select an appropriate position for such temperature sensor 9 in order to practice the present invention.

In the household appliance 1 according to the present invention both the first humidity sensor 8, and the temperature sensor 9 are connected to a control unit 10. Said control unit 10 is capable of controlling the input and the output of steam into or out from the cavity 3, respectively, and additionally, optionally, the input and/or output of cooling air into the cavity 3. This control preferably is mediated by closing and/or opening of said at least one duct 6 and/or operating said fan element 7 and/or controlling a humidity controlling means, particularly a humidity generating means 14, preferably the steam generator 14.

During the entire cooking process, but particularly starting at the end of a boost cycle operation of said household appliance 1 the first humidity sensor 8 may continuously measure in the cooling compartment 5 an input humidity value of the air contained in said compartment 5, which is correlated by the control unit 10 to a humidity index value.

During a cooking cycle operation of said household appliance 1 and, optionally during a desteaming cycle operation of said household appliance 1, the first humidity sensor 8 continuously measures the relative humidity in the compartment 5, and the temperature sensor 9 continuously measures the temperature in the cavity 3, respectively. As both sensors 8 and 9 are connected to the control unit 10, said control unit correlates the respective continuously measured input values of the first humidity sensor 8 and the temperature sensor 9 to a humidity index value.

This correlation is based on correlating said input values of said at least one first humidity sensor 8 and of said temperature sensor 9 to a matrix, which is deposited in said control unit 10. Such a matrix, in way of a non-limiting example, is shown in FIG. 3.

Particularly, said correlation of the input value(s) with said index humidity value may be based on such matrix, particularly such simple lookup table as depicted in FIG. 3, which preferably is deposited in an appropriate electronic form in the control unit 10, i.e. capable to be processed. In the exemplary matrix shown in FIG. 4 columns represent ranges of temperature, here split in steps of 10° C., over the overall temperature working range of the household appliance 1.

The rows in said matrix indicate the humidity index ranging from a relative humidity value of 0% to 100%, for example, in steps of 10%. The matrix itself has be then filled and populated with sensor values, serving as reference to the actually measured values. Said actually measured values serving as reference values where advantageously achieved experimentally by a set of tests using a reference humidity sensor placed in the cavity 3 of the household appliance 1.

Said at least one first sensor 8 and said at least one second sensor 9 is connected to the control unit 10, and said control unit is capable of correlating said input value of said at least one first sensor 8 and of said at least one second sensor 9 to a humidity index value being selectable from such matrix comprising such humidity index value(s).

Said at least one first sensor 8 and said at least one second sensor 9 is connected to a control unit 10, capable of correlating said input value of said at least one first sensor 8 and/or said at least one second sensor 9 to a humidity index value.

For such correlation said input value of said at least one first sensor 8 and of said at least one second sensor 9 is compared to such matrix comprising such humidity index values, and said humidity index value is further compared to a set humidity value, and subsequently an output signal for controlling a humidity controlling means 14, e.g. the steam generator is determined and/or generated.

A set humidity value is preferably set according to the desired conditions of the cooking process. It will be immediately understood that the user may set such set humidity value directly. For example, by selecting the desired humidity value. However, a household appliance 1 according to the present invention may also, particularly in its control unit 10, comprise default receipts, for example, for different kind of foodstuff and/or cooking processes. It will be also understood that desired humidity value during a boost cycle and desired humidity value during a cooking cycle may be independently set. However, also a combination of desired humidity value during a boost cycle and desired humidity value during a cooking cycle may be suggested to the user according to a desired cooking process, e.g. a receipt, preferably stored in the control unit.

The set humidity value is preferably set by the user, like other cooking conditions, e.g. temperature and time, of a desired cooking process, depending on the specific cooking process to be performed. The boost cycle set value is preferably chosen such that the humidity value within the cavity at the end of the boost cycle is similar to the set humidity value of the cooking cycle.

It will be immediately understood that the set humidity value is basically a value of humidity, and it may be set as the other parameters, e.g. time or temperature, by the user, according to cooking process. The estimated humidity index value is used as a control threshold, basically enabling/increasing steam generation if humidity is insufficient, i.e. below the set humidity value, and/or reducing/blocking it if humidity is ok or exceeding the set humidity value.

The steps of a method according to the present invention are highlighted by the various arrows in FIG. 3. Accordingly, after adjustment of a set humidity value for a boost cycle and adjustment of a set humidity value for a cooking cycle and, optionally, for a de-steaming cycle of a cooking process, preferably by a user input, a step of humidity control, carried out during the cooking cycle and, optionally, the desteaming cycle. Particularly, said step of humidity control comprising at least the following steps:

i) continuously measuring an input value by the at least one first sensor 8 and continuously measuring an input value by the at least one second sensor 9;

ii) continuously correlating said input value of said at least one first sensor 8 and/or said at least one second sensor 9 to a humidity index value from the matrix, wherein said matrix comprises such humidity index value(s) deposited in the control unit 10 of the household appliance 1, said correlation comprising comparing said input value of said at least one first sensor 8 and said at least one second sensor 9 to the matrix;

iii) comparing said humidity index value from step ii) to the set humidity value for a boost cycle and/or the cooking cycle and/or the de-steaming cycle of a cooking process from step a); and iv) determining and/or generating an output signal for controlling a humidity controlling means 14, particularly a humidity generating means 14, preferably a steam generating means 14;

v) controlling said humidity controlling means 14 and generating a humidity value in the cavity 3 according to the output signal.

The above described correlation and determination of the output value, in other words the deduction of the humidity index from said measured input value(s), may be preferably achieved by three consecutive or simultaneous steps highlighted by the various arrows in FIG. 3:

At first, a temperature value is measured as an input value of the temperature sensor 9 in the cavity 3, for example, using a standard cavity temperature sensor. According to said measured input temperature value, the appropriate correlation matrix column is selected. For example, a temperature input value was measured which was in a certain temperature range. At second, the humidity sensor 8 measures its input value, i.e. an actual relative humidity value within the compartment 5, which is assigned to the appropriate value in the selected matrix column. In this particular example, the appropriate humidity index value according to the respective temperature column of the temperature range is selected. Said appropriate humidity index value is a value proportional to the input signal of relative humidity measured as an input signal by the first humidity sensor 8 in the compartment 5, particularly in the cooling air stream of the air-cooling channel and/or cooling chamber 5. It will be understood that the control unit 10 is configured such that a value in the selected temperature column may be identified being the most similar value in the selected correlation matrix column, particularly if such column represents a certain temperature range of about 10° C. or 5° C. steps. According to said selection of the appropriate humidity value in the selected matrix column, a respective humidity index value, here representing an estimated humidity index value, is assigned as an output signal. Said output signal may be than used to control various operations of the household appliance 1, particularly, for controlling the humidity controlling means 14, particularly a humidity generating means 14, particularly the operation of the steam generator 14. However, further other operations may be controlled based on said output signal, for regulating and/or controlling the humidity and/or temperature in the cavity. Particularly, controlling of a heating element, a steam generator means, valves for pressure and/or fluid outlets and/or inlets, particularly vapor and/or steam outlets and/or inlets, control of water inlet means, e.g. shut-off valve means or steam and vapor outlet adjustment means, valves and/or inlet and/or outlet ducts. It should be noted that according to the table provided in FIG. 4 as an example, the range of use of the control is indicated as a temperature range from 80 to 230° C. However, it is to be understood that the method and/or the household appliance according to the present invention is not bound thereto.

Particularly, the household appliance 1 according to the embodiment depicted in FIGS. 1 and 2 comprises at least one duct 6, which is in fluid communication with the compartment 5 and the cavity 3, through at least one outlet opening 11 of said cavity 3 for exhaustion of air and/or vapor and/or steam or a mixture thereof, out of the cavity 3 and into said compartment 5. More particularly, the household appliance 1 according to the embodiment depicted in FIG. 2 may comprise at least one further duct 6, which is in fluid communication with the compartment 5 and the cavity 3, through at least one inlet opening 12 of said cavity 3 for influx of air and/or vapor and/or steam or a mixture thereof, for example, generated by said fan element 7 and/or a humidity controlling means, particularly a humidity generating means 14, into the cavity 3. Such duct 6, may be advantageously opened or closed by at least one valve 13, which may be configured as a throttle valve and/or an electric valve.

The above-described correlation of said input value of said humidity sensor 8 and said temperature sensor 9 to the respective humidity index value occurs continuously during a cooking cycle operation of said household appliance 1, and advantageously allows estimating and thus controlling the actual relative humidity in the cavity 3. Particularly, the methods and/or household appliances according to the herein described embodiments of the invention advantageously allow the possibility to combine different conditions of humidity during different phases of a cooking operation, particularly during boost cycle and/or cooking cycle. Such operations are advantageously controlled and/or tunable by the steam generator duty cycle, particularly in the boost cycle, and the humidity value desired and/or achieved during a cooking cycle. Said humidity values within the cavity may be advantageously controlled and/or monitored by the method and/or household appliance according to the present invention. Said humidity values are particularly used to control the steam generator operation in closed loop.

Figure 5:
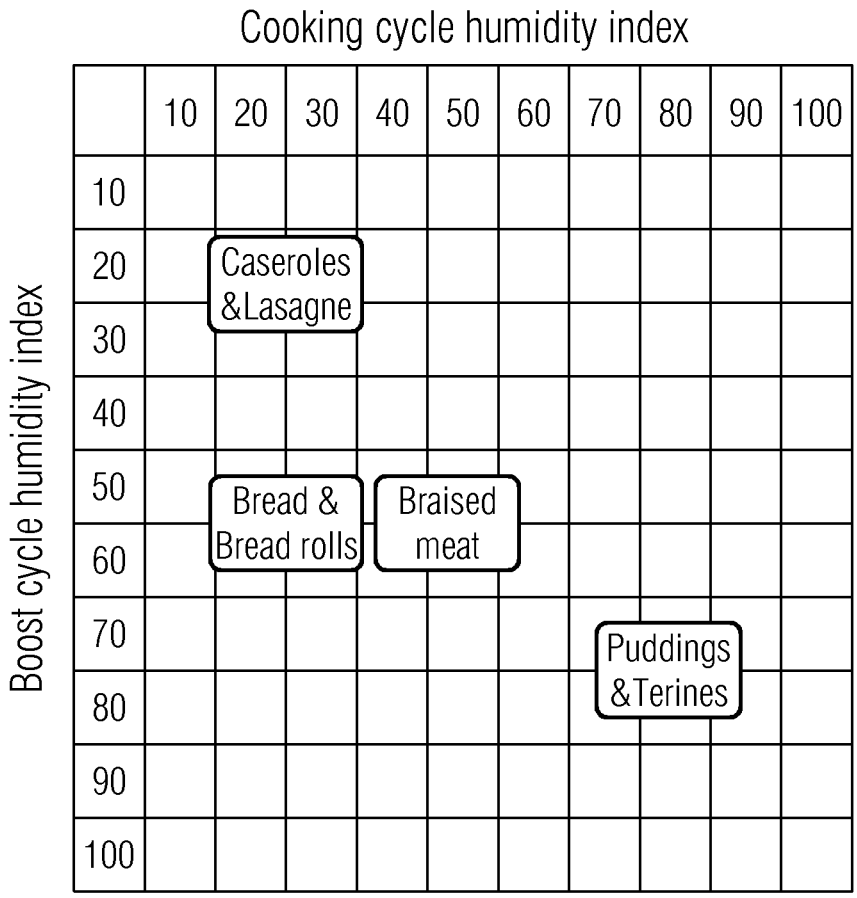
FIG. 5 illustrates an exemplary diagram depicting various combinations of humidity values for boost and cooking cycle.

FIG. 5 shows such combination and/or examples of the various possible humidity index values depending on the accordingly chosen boost cycle steam generator performance are depicted. FIG. 6 depicts exemplarily the completely available matrix of combinations between boost cycle humidity values and humidity values during a cooking phase, particularly represented by the set humidity values. As may be taken from FIG. 5 for different desired cooking processes, and particularly for different categories of foodstuff, different combinations can be chosen to create the ideal cooking; examples are reported in FIG. 5.

In this way, it is possible to deliver the desired right amount of humidity for each cooking phase and/or desired receipt. In connection therewith, it is to be understood that it is according to the receipt and cooking process to be performed often important and desired, particularly in an early phase of a cooking process, particularly in a boost cycle and/or in an early phase of the cooking cycle, to achieve special, specific or different conditions with respect to the rest of the cooking process itself.

Figure 4:
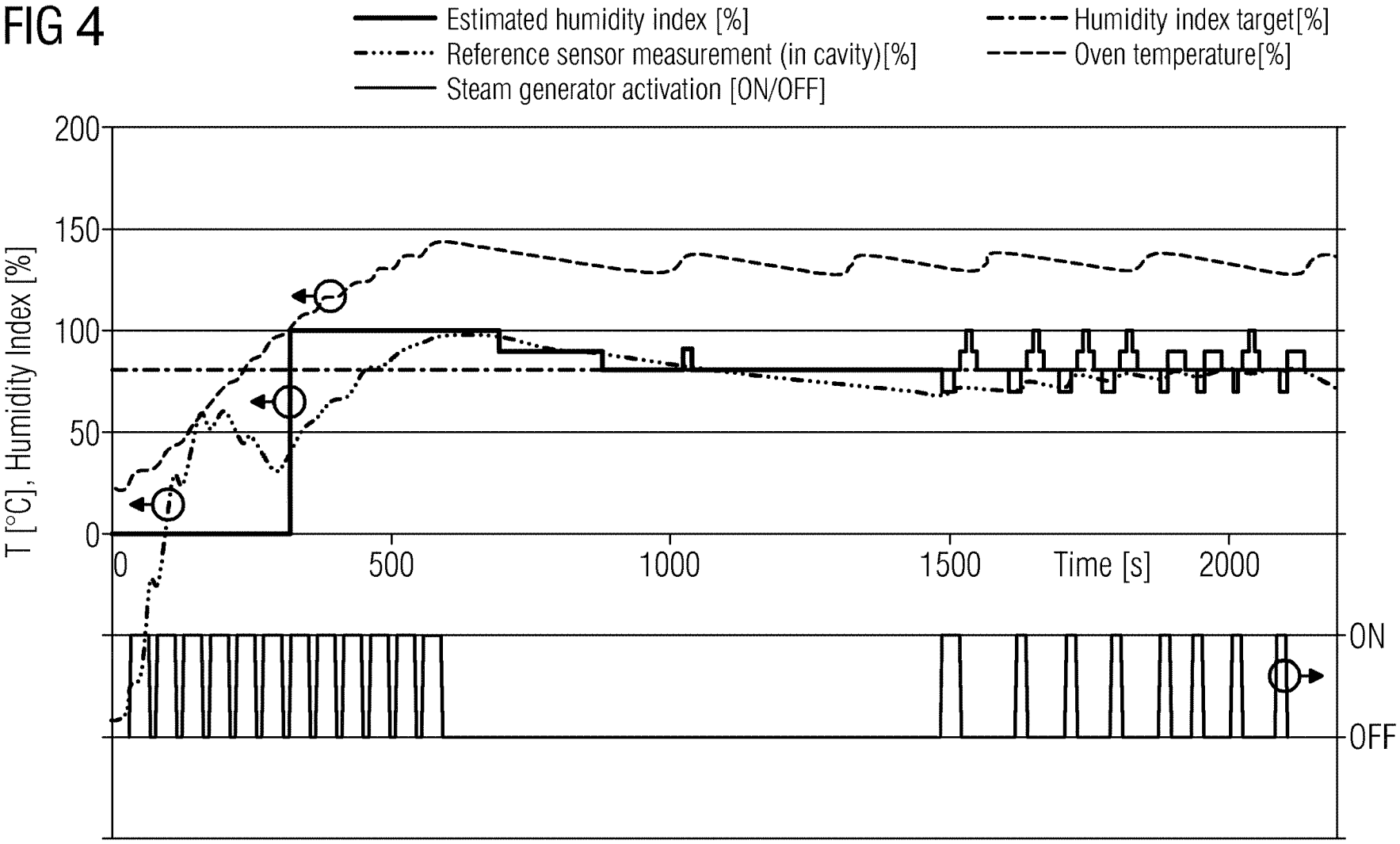
FIG. 4 illustrates an exemplary diagram of humidity index vales over time during a cooking operation according to the inventive method.

The graphs depicted in FIG. 4 represent a typical example for a cooking operation carried according to the method of the present invention. Particularly, in the present example, a boost cycle and cooking cycle set humidity value is chosen to keep a m relatively high humidity during the cooking cycle in the oven cavity 3 of about 80%, and thus set said value as the set humidity value for the cooking cycle. As may be taken from the depicted reference measurement using a reference sensor placed in the cavity, the actual relative humidity measured within the cavity is advantageously achieved by the present invention almost similar to said desired set humidity value during almost the entire cooking cycle. It will be immediately understood that the here indicated reference sensor measurement is not part of the invention; this is a direct measurement achieved with a laboratory system, meant to proof the accuracy of the invented method relying on a indirect measurement. Particularly, the desired set humidity value of about 80% relative humidity within the cavity 3 is depicted as a dashed line. As may be seen said FIG. 4 in a performed boost cycle of about 500 sec, which may be identified by an initial intensive operation of the steam generator from the lower part of the FIG. 4, the oven temperature raises to about 150° C., measured by the first temperature probe 9 within the cavity 3.

An accordingly correlated humidity index value is depicted, which is correlated and deduced from the actual measurement of the input values of the temperature sensor 9 and the first humidity sensor 8 according to the method of the present invention. It can be immediately seen, that when the actual relative humidity value gets smaller than the desired set humidity value, the steam generator 14 again starts to operate and thus, the desired set humidity value is reached again in relative short time. This is possible as the control unit 10, which correlates the actually measured input values of the first sensor 8 in the compartment 5 and the temperature sensor 9 in the cavity 3 to an estimated humidity index value from the matrix, which serves as an output signal to control the steam generator 14.

This is, as the first sensor 8 and the temperature sensor 9 are connected to the control unit 10, which is capable of correlating said input values of said first sensor 8 and said temperature sensor 9 to a humidity index value.

The features of the present invention disclosed in the specification, the claims, and/or the figures may both separately and in any combination thereof be material for realizing the invention in various forms thereof.

LIST OF REFERENCE NUMERALS

1 Household appliance
2 foodstuff or bakery ware
3 cavity
4 access door
5 compartment
6 duct
7 fan element
8 first sensor
9, 9*a*, 9*b* second sensor
10 control unit
11 outlet opening
12 inlet opening
13 valve
14 humidity controlling means, particularly a humidity generating means
15 upper wall of the cavity
18 bottom wall of the cavity
17 side wall of the cavity
18 second humidity sensor
19 setting means
20 cochlea
21 grid
22 cavity rear wall

23 central fan
24 fan shield
25 motor
26 throttling valve actuator
27 throttling valve
28 Exhaust manifold from oven cavity

The invention claimed is:

1. Household appliance for cooking and/or baking food stuffs or bakery ware comprising:

a heatable cavity for food stuffs or bakery ware, an access door for accessing the cavity, a compartment located exterior of said cavity, said compartment being in fluid communication with said cavity by at least one duct, a control unit, at least one first sensor located in the compartment and being connected to the control unit, and wherein the at least one first sensor is capable of measuring a first input value in said compartment, and at least one second sensor capable of measuring a second input value, wherein said second input value is a temperature value, wherein said control unit comprises a matrix of humidity index values, wherein said control unit is adapted to correlate said first input value and said second input value to a humidity index value from said matrix throughout a steam cooking operation of a cooking process and to compare said humidity index value to a set humidity value throughout the steam cooking operation, said control unit being further adapted to determine and/or generate an output signal for controlling a humidity controlling means based on said comparison throughout the steam cooking operation.

2. Household appliance according to claim 1, wherein said at least one first sensor capable of measuring a first input value is a humidity sensor, and wherein said first input value is a humidity value within said compartment.

3. Household appliance according to claim 1, wherein said compartment comprises at least one mixing element for mixing and/or diluting a fluid from the cavity with air.

4. Household appliance according to claim 3, wherein said at least one mixing element is located in fluidic connection with said compartment and/or wherein said at least one mixing element is a radial fan or a tangential fan.

5. Household appliance according to claim 3, wherein said fluid is fresh and/or cold air, steam, vapor and/or a mixture thereof.

6. Household appliance according to claim 1, wherein said at least one first sensor and said at least one second sensor are connected to the control unit.

7. Household appliance according to claim 1, said at least one first sensor being located at a position exposed to temperatures of about 100° C. or less and/or exposed to relative humidity of about 100% or less during operation of said household appliance.

8. Household appliance according to claim 1, wherein said compartment is a cooling channel and/or a cooling chamber, and/or wherein said compartment is located on top of said cavity.

9. Household appliance according to claim 1, wherein the at least one duct is in fluid communication with the compartment and said cavity:

through at least one outlet opening of said cavity for exhaustion of air and/or vapor and/or steam or a mixture thereof, out of the cavity into said compartment, and/or through at least one inlet opening of said cavity for influx of air and/or vapor and/or steam or a mixture thereof from said compartment into the cavity, wherein, said at least one duct can be opened or closed by at least one valve.

10. Household appliance according to claim 9, wherein the at least one outlet opening is arranged in an upper area of the cavity, and/or wherein the inlet opening is arranged in a lower bottom area of the cavity.

11. Household appliance according to claim 1, wherein the at least one second sensor is located in the cavity in a wall thereof, or is located in the compartment, or wherein one second sensor is located in the cavity wall and a further second sensor is located in the compartment.

12. Household appliance according to claim 1, comprising at least one further first sensor located in the cavity, said at least one further first sensor being connected to the control unit, wherein the at least one further first sensor is capable of measuring a humidity value within said cavity as an input value of said at least one further first sensor.

13. Household appliance according to claim 1, wherein the steam cooking operation comprises: a boost cycle wherein the heatable cavity is heated to a set temperature and taken to the set humidity value, and a cooking cycle wherein the set temperature and the set humidity value are maintained.

14. Household appliance according to claim 1, wherein the cooking process further includes a non-steam cooking operation.

15. Method for controlling humidity in a cavity of a household appliance, comprising at least the following steps:

a) adjusting a set humidity value for a boost cycle and/or a cooking cycle and/or a de-steaming cycle of steam cooking operation of a cooking process by a user input;

b) humidity control carried out throughout the steam cooking operation, said step of humidity control comprising at least the following steps:

i) measuring a first input value by the at least one first sensor and measuring a second input value by the at least one second sensor;

ii) correlating said first input value and said second input value to a humidity index value from a matrix, wherein said matrix comprises such humidity index value, said matrix being deposited in a control unit of the household appliance, said correlation comprising comparing said first input value and/or said second input value to the matrix;

iii) comparing said humidity index value from step ii) to a set humidity value for a boost cycle and/or a cooking cycle and/or a de-steaming cycle of a cooking process from step a);

iv) determining and/or generating a humidity output signal for controlling a humidity controlling means based on the comparison from step iii); and v) controlling said humidity controlling means and generating a humidity value in the cavity according to the humidity output signal.

16. An appliance comprising a heatable cavity for cooking food stuffs, a compartment located exterior of said cavity and being in fluid communication therewith via a duct that can be opened and closed via a valve, a first sensor for measuring a first input value comprising at least one of a first temperature value and a first humidity value measured at a location within said compartment where the temperature is about or less than 100° C. during operation of said appliance, a second sensor for measuring a second input value comprising a second temperature value within said cavity, said compartment comprising a fan for diluting with ambient air cooking fumes entering said compartment from said cavity via said duct and for exhausting a mixture of said cooking fumes and said ambient air from within said compartment out of the appliance, a humidity controlling means adapted to introduce steam into said cavity, a control unit in operative communication with each of said first sensor, said second sensor, said valve and said humidity controlling means, said control unit being adapted to continuously receive first input value data from said first sensor and second temperature value data from said second sensor and to continuously correlate said first and second input values with a corresponding humidity index value from a lookup table, said control unit being further adapted to continuously compare said continuously correlated humidity index value to a set humidity value to thereby regulate the humidity in said cavity in order to target said humidity index value to said set humidity value by:

actuating said valve to facilitate expulsion of humidity-laden cooking fumes from said cavity through said duct; and operating said humidity generating means to introduce steam into said cavity.

17. The appliance according to claim 16, said set humidity value being either user-selected or stored in a predetermined cooking program.

18. The appliance according to claim 16, said compartment being located above said cavity and said duct being in communication with said cavity via an outlet opening in an upper wall of said cavity, said humidity controlling means being in communication with said cavity via an inlet opening arranged in a lower area of said cavity.

* * * * *